US010159339B1

(12) United States Patent
Powell et al.

(10) Patent No.: US 10,159,339 B1
(45) Date of Patent: Dec. 25, 2018

(54) SHELVING BRACKET

(71) Applicant: Metal Masters Foodservice Equipment Co., Inc., Clayton, DE (US)

(72) Inventors: Brian Christopher Powell, Dover, DE (US); Eric Christopher Yocum, Dover, DE (US); David U. Ezeani, Clayton, DE (US); David Neal Schucker, Dover, DE (US); Tim Oliphant, Townsend, DE (US)

(73) Assignee: Metal Masters Foodservice Equipment Co., Inc., Clayton, DE (US)

( * ) Notice: Subject to any disclaimer, the term of this patent is extended or adjusted under 35 U.S.C. 154(b) by 0 days.

(21) Appl. No.: 15/881,957

(22) Filed: Jan. 29, 2018

Related U.S. Application Data

(60) Provisional application No. 62/453,617, filed on Feb. 2, 2017.

(51) Int. Cl.

| | |
|---|---|
| ***A47B 57/40*** | (2006.01) |
| ***A47B 47/02*** | (2006.01) |
| ***A47B 57/48*** | (2006.01) |
| *A47B 57/06* | (2006.01) |

(52) U.S. Cl.
CPC ..... *A47B 57/406* (2013.01); *A47B 47/022* (2013.01); *A47B 47/028* (2013.01); *A47B 57/485* (2013.01); *A47B 57/06* (2013.01)

(58) Field of Classification Search
CPC ... A47B 57/485; A47B 57/406; A47B 47/022; A47B 47/028; A47B 57/06
USPC ..... 248/235, 239, 241, 243, 250; 211/187, 211/188, 90.01, 90.02, 135, 134, 86.01; 108/108
See application file for complete search history.

(56) References Cited

U.S. PATENT DOCUMENTS

| | | | | | |
|---|---|---|---|---|---|
| 26,840 | A | * | 1/1860 | Duchanny | A47C 16/04 182/230 |
| 701,079 | A | * | 5/1902 | Peckham | A47B 57/42 248/243 |
| 875,970 | A | * | 1/1908 | Watt | A47B 57/42 248/243 |
| 901,926 | A | * | 10/1908 | Watt | A47B 96/061 248/235 |

(Continued)

FOREIGN PATENT DOCUMENTS

| | | |
|---|---|---|
| GB | 608480 | 9/1948 |

*Primary Examiner* — Jonathan Liu
*Assistant Examiner* — Devin K Barnett
(74) *Attorney, Agent, or Firm* — Rogowski Law LLC

(57) ABSTRACT

A shelving system includes brackets attached to support posts to hold the shelves above a horizontal support surface, such as a ground or floor. The support posts have a plurality of spaced apart projecting pins extending from opposite sidewalls thereof. The brackets each have a flange that defines holes to receive respective ones of the projecting pins. Each bracket is further secured to a support post with a C-shaped locking clip having first and second arms with hook-shaped fingers that hook around respective pins on opposite sidewalls of the support post. One of the arms of the C-shaped locking clip holds the bracket flange against the inner sidewall of the support post and the hook-shaped finger of such arm mates with one of the pins received in one of the holes of the bracket.

15 Claims, 13 Drawing Sheets

(56) References Cited

U.S. PATENT DOCUMENTS 1,034,365 A * 7/1912 Hauser ..... A47B 57/56 248/246
1,702,937 A * 2/1929 Friedemann ..... A47F 3/12 248/242
1,876,172 A 9/1932 Ruddy
1,983,858 A * 12/1934 Karnes ..... A47B 57/30 108/108
2,216,912 A * 10/1940 Hoitsma ..... E04G 1/20 182/131
2,605,074 A * 7/1952 Bucsko ..... E04G 5/06 182/187
2,644,591 A * 7/1953 Franklin ..... A47F 5/103 211/187
2,788,949 A * 4/1957 Gurries ..... A47B 57/045 211/134
2,919,034 A * 12/1959 Levy ..... A47B 57/045 108/1
2,940,601 A * 6/1960 Smith ..... A47B 57/425 108/152
3,055,462 A * 9/1962 Steele ..... A47B 57/50 211/191
3,097,822 A * 7/1963 Attwood ..... A47B 57/045 248/250
3,212,648 A * 10/1965 Baker, Jr. ..... A47B 47/022 108/108
3,286,662 A * 11/1966 Connery ..... A47B 57/485 108/108
3,355,134 A * 11/1967 Chesley ..... A47B 96/025 108/108
3,358,621 A * 12/1967 Szacsko ..... A47B 57/045 108/92
3,473,774 A * 10/1969 Riblet ..... A47B 57/56 182/146
3,572,626 A * 3/1971 Bertschi ..... A47B 57/045 248/242
3,602,374 A * 8/1971 Alabaster ..... A47B 57/485 211/193
3,603,274 A * 9/1971 Ferdinand ..... A47B 57/425 108/108
3,700,114 A 10/1972 Myers
3,710,734 A * 1/1973 Bofferding ..... A47B 57/56 108/108
3,868,986 A * 3/1975 Olsen ..... B22C 7/023 108/107
4,008,873 A * 2/1977 Travaglio ..... A47B 57/045 108/108
4,039,064 A * 8/1977 Kirby ..... B23Q 3/10 193/42
4,368,800 A * 1/1983 Campbell ..... E04G 1/15 182/133
4,452,336 A * 6/1984 Sickler ..... E04G 5/04 182/82
4,463,828 A * 8/1984 Anderson ..... A63B 27/00 182/136
4,754,841 A * 7/1988 Koffski ..... E06C 9/04 182/100
4,969,620 A * 11/1990 Plummer ..... E06C 1/381 248/239
5,259,478 A * 11/1993 Berish ..... A63B 27/00 182/136
5,592,886 A * 1/1997 Williams ..... A47B 57/52 108/108
5,655,740 A * 8/1997 Lazarus ..... A47B 57/30 108/108
5,695,163 A * 12/1997 Tayar ..... A47B 57/485 248/225.21
5,868,263 A * 2/1999 McAllister ..... A47B 57/485 108/108
5,975,241 A * 11/1999 Berish ..... A63B 27/00 182/136
6,098,552 A * 8/2000 Gunderson ..... A47B 96/061 108/108
6,273,381 B1 * 8/2001 Riblet ..... E04G 5/06 248/248
6,402,108 B1 * 6/2002 Remmers ..... A47B 57/42 211/181.1
6,431,090 B1 8/2002 Davis
7,152,835 B1 * 12/2006 Riblet ..... E04G 1/20 248/246
7,258,317 B1 * 8/2007 Nagel ..... A47B 96/025 108/108
7,407,060 B2 * 8/2008 Swartz ..... A47B 96/067 211/190
7,494,019 B2 2/2009 Kessell
8,684,319 B2 * 4/2014 Brouwer ..... H02G 3/0443 248/49
9,044,090 B2 6/2015 Drake
9,119,471 B2 9/2015 Gonzalez
10,021,972 B1 * 7/2018 Robinson ..... A47B 57/30
2002/0178976 A1 * 12/2002 Bohnacker ..... A47B 96/061 108/108
2003/0226944 A1 * 12/2003 Sode ..... A47B 57/56 248/243
2004/0050814 A1 * 3/2004 Roush ..... A47F 5/0018 211/201
2005/0127017 A1 * 6/2005 Kessel ..... A47B 57/06 211/187
2005/0204966 A1 * 9/2005 Bienick ..... A47B 57/48 108/108
2006/0255221 A1 * 11/2006 Tseng ..... A47B 57/567 248/235
2007/0235611 A1 * 10/2007 Riblet ..... A47B 57/567 248/248
2008/0048080 A1 * 2/2008 Riblet ..... E04G 5/061 248/235
2010/0155353 A1 * 6/2010 McAllister ..... A47B 96/028 211/153
2012/0223041 A1 9/2012 Lee
2014/0001135 A1 * 1/2014 Bukowski ..... D06F 57/12 211/100
2014/0027589 A1 * 1/2014 Durgin ..... A47B 96/06 248/218.4
2014/0263125 A1 * 9/2014 Gonzalez ..... A47B 96/1408 211/134
2015/0335155 A1 * 11/2015 Winker ..... A47B 87/005 211/90.02
2016/0346582 A1 12/2016 Wilkinson
2018/0132611 A1 * 5/2018 Lu ..... A47B 61/003

* cited by examiner

SHELVING BRACKET

CROSS-REFERENCE TO RELATED APPLICATION

This invention claims priority under 35 U.S.C. § 119(e) to U.S. Provisional Application Ser. No. 62/453,617, entitled "Shelving Bracket" filed Feb. 2, 2017, the disclosure of which is incorporated by reference herein.

BACKGROUND OF THE INVENTION

The present invention relates to support brackets, and more particularly to shelving systems having support brackets that join to mounting posts or vertical mountings.

Cantilevered shelves may be mounted to free-standing posts or to wall-mounted attachments. Particularly for shelving units for use in the food industry, cantilevered shelves must be adapted for hanging at different height levels, easily moved and removed, and easily cleaned while still mounted to the support posts. The shelves also must be adapted to hold significant loads without deformation or failure. Cantilevered shelves are susceptible to bending, buckling, fracturing or breaking when subjected to repeated impact loading.

Therefore, improvements to brackets to secure cantilevered shelves to mounting posts continue to be sought.

SUMMARY OF THE INVENTION

In a first aspect, a shelving system has in combination (1) a first support post, (2) a second support post, (3) at least one shelf assembly with a first bracket and a second bracket that support a shelf structure, and (4) locking clips. The first support post has a front surface, a first mounting surface and a second mounting surface, and a first plurality of outwardly projecting pins extending from the first mounting surface, and a second plurality of outwardly projecting pins extending from the second mounting surface. The second support post similarly has a front surface, a first mounting surface and a second mounting surface, and a first plurality of outwardly projecting pins extending from the first mounting surface, and a second plurality of outwardly projecting pins extending from the second mounting surface. The shelf assembly includes a first bracket having two or more through holes with each hole adapted to engage a respective one of the outwardly projecting pins from the first mounting surface, and a second bracket having two or more through holes with each hole adapted to engage a respective one of a plurality of outwardly projecting pins from the mounting surface of the second post. The shelf assembly further includes one or more cross-bars and/or a shelf structure that are/is joined at one end to the first bracket and at an opposite end to the second bracket to define a shelf surface of the shelving assembly. The brackets are secured to the first and second support posts by engaging the bracket holes with respective pins from the mounting surfaces of the posts. One bracket is engaged to a first mounting surface of the first support post, and one bracket is engaged to a second mounting surface of the second support post.

The brackets may be two-part, with a flange and a separate side wall, with the two or more through holes extending through the flange. In such embodiment, the sidewall of the bracket defines a channel and the flange has an arm that nests within the channel.

The brackets are further secured to the first and second support posts with locking clips. A first locking clip has a C-shape with a first arm having a first hook shaped finger extending outwardly therefrom and with a second arm having a second hook shaped finger extending outwardly therefrom, with the first hook shaped finger adapted to receive the one of the outwardly projecting pins of the first mounting surface of the first support post also engaged by the first bracket and with the second hook shaped finger adapted to receive one of the outwardly projecting pins of the second mounting surface of the first support post. A second locking clip has a C-shape with a first arm having a first hook shaped finger extending outwardly therefrom and with a second arm having a second hook shaped finger extending outwardly therefrom, with the first hook shaped finger adapted to receive the one of the outwardly projecting pins of the first mounting surface of the second support post also engaged by the second bracket and with the second hook shaped finger adapted to receive one of the outwardly projecting pins of the second mounting surface of the second support post.

The first arm of the first locking clip may have a wall portion spaced apart from the first hook-shaped finger, with said wall portion having a width that is less than a space between two adjacent outwardly projecting pins extending from the first mounting surface of the first support post. The inner wall of the first arm of the first locking clip thus contacts the first mounting surface of the first support post. The second arm of the first locking clip may have a second wall portion spaced apart from the second hook-shaped finger, with said second wall portion having a width that is less than a space between two adjacent outwardly projecting pins extending from the second mounting surface of the first support post. The inner wall of the second arm of the first locking clip thus contacts the second mounting surface of the first support post.

The wall portion of the first arm of the first locking clip in one advantageous embodiment contacts the first mounting surface of the first support post at a location below the one of the outwardly projecting pins of the first mounting surface engaged by the first hook shaped finger, the body of the first locking clip contacts the front surface of the first support post, and the second arm of the first locking clip contacts the second mounting surface of the first support post.

Multiple shelf assemblies may be attached to the same two support posts, whether at different heights from the horizontal support, or at the same height but extending opposite from the mounting surface of the first shelf assembly.

Multiple brackets of shelf assemblies may be secured to a same support post at a same height on opposite mounting faces of the support post using a single locking clip. This enables storage units to include three support posts, with the center post supporting shelf assemblies adjacent to one another.

DESCRIPTION OF THE DRAWINGS

The invention, its effects, and advantages will be explained in more detail on the basis of the schematic drawings, in which.

DETAILED DESCRIPTION OF EMBODIMENTS

Figure 1:
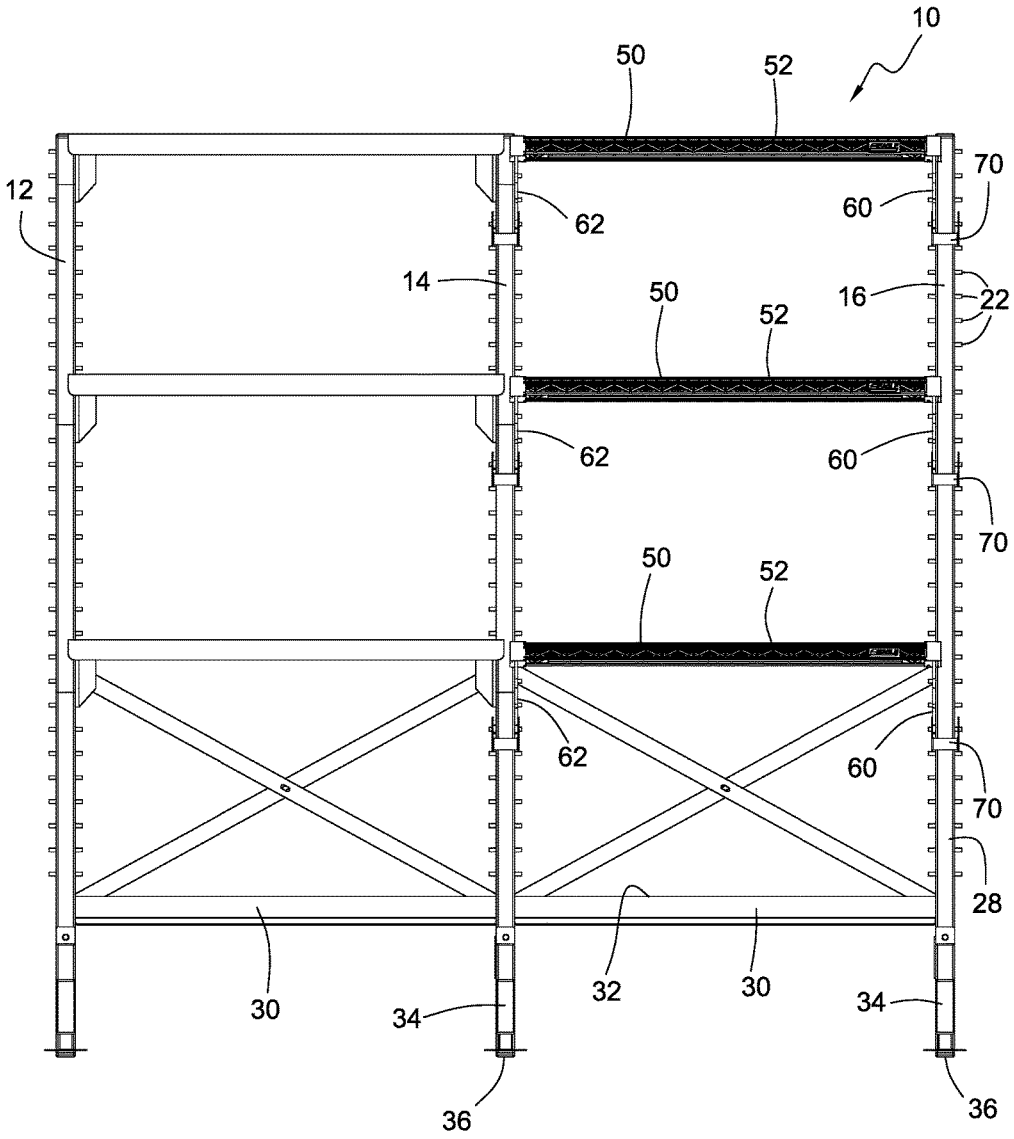
FIG. 1 is a front elevational view of a shelving unit of a first embodiment having three mounting posts and multiple shelves with shelving brackets according to the invention attached thereto.
Figure 2:
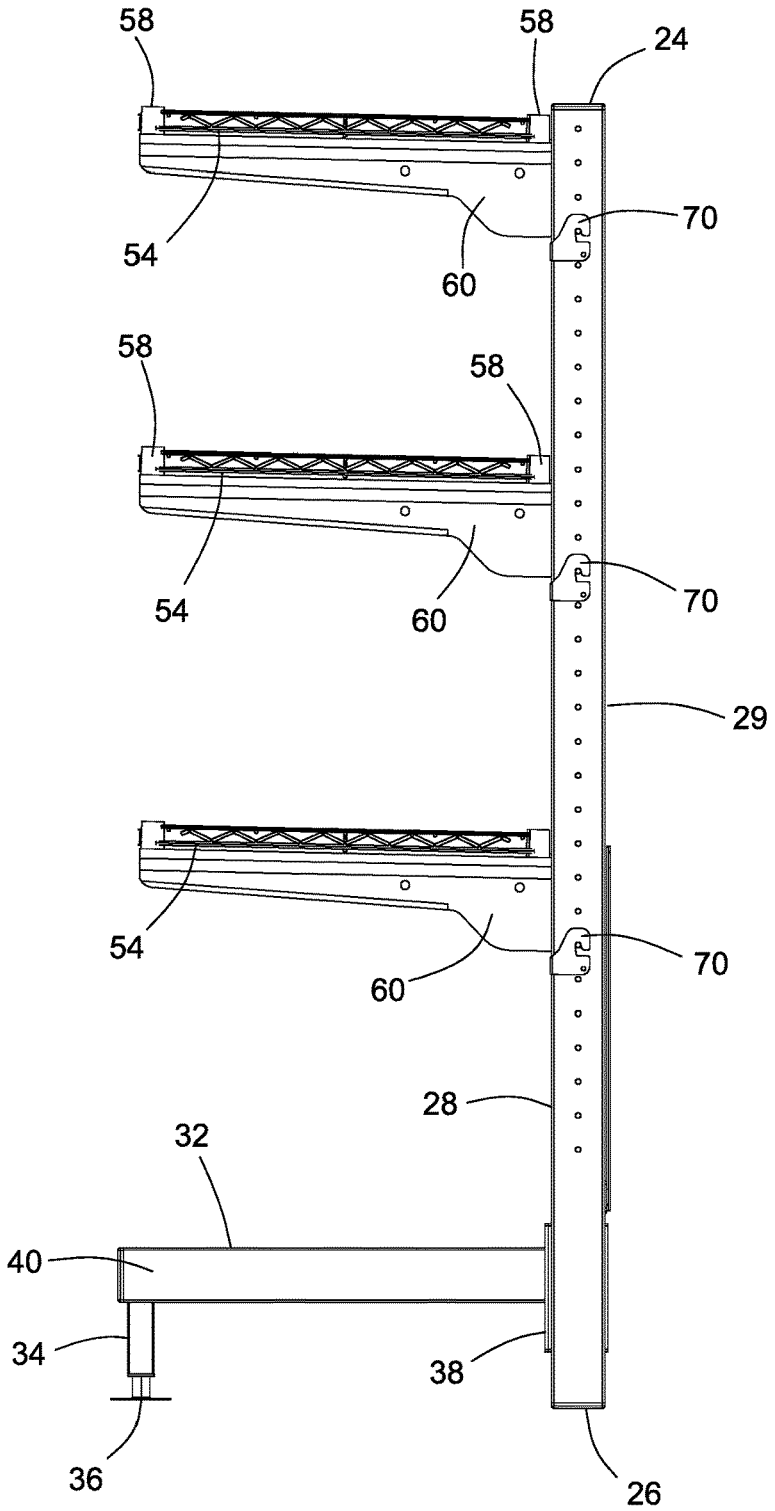
FIG. 2 is a right side elevational view of the shelving unit of FIG. 1.
Figure 3:
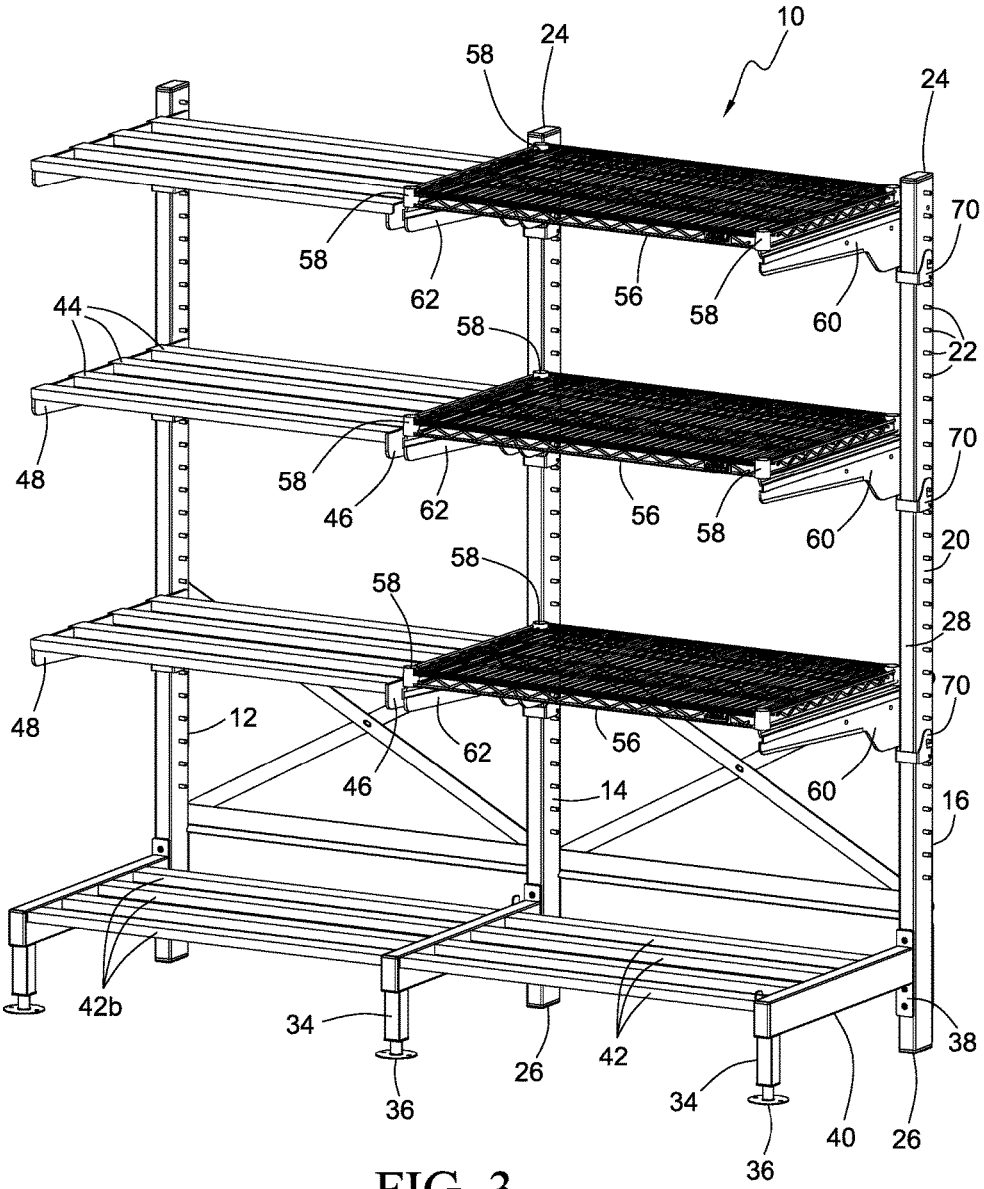
FIG. 3 is a right front perspective view of the shelving unit of FIG. 1.

FIGS. 1-7 show a first embodiment of a shelving system 10 having three vertical support posts 12, 14, 16 from which a series of cantilevered shelves 50 is supported. Each support post 12, 14, 16 has a front surface 28, a first mounting surface 18 and a second mounting surface 20 opposite from the first mounting surface 18. A series of outwardly projecting pins 22 extends from each of the first mounting surface 18 and the second mounting surface 20. The outwardly projecting pins 22 are spaced apart from one another preferably at a regular interval. The pins 22 of each post 12, 14, 16 are established in positions that substantially register with the pins 22 of an adjacent post. Pins 22 project from both the first mounting surface 18 and the second mounting surface 20, and the front surface 28 remains planar (without pins extending therefrom).

Each shelf assembly 50 has a first bracket 60 spaced apart from a second bracket 62 to define a shelf or a supporting surface 52. Optionally, various shelf types may be installed onto the brackets, including but not limited to wire truss configurations, parallel bar configurations, and solid shelving. See, e.g., U.S. Pat. Nos. 5,390,803 and 6,345,795 for alternative shelf types.

The shelving system 10 shown in FIG. 1 has four rows of shelves 30, 50. On the right side, the top three series of shelving assemblies have wire truss shelves 50 joined to the shelving brackets 60, 62. Each wire truss shelf 50 has two side trusses 54 and a front truss 56 and rear truss 57. The trusses 54, 56, 57 support the series of parallel wires forming the wire shelf. The trusses 54, 56, 57 are connected at each end to a corner 58. The corner 58 comprises a hollow or substantially hollow cylinder adapted to receive an upstanding prong 64 of a shelf bracket 60. The shelf brackets 60 are configured for removable attachment to the support posts 14, 16.

The bottom row shelf on the right side comprises a shelving assembly 30 wherein the shelf top surface 32 is formed by one or more cross-bars 42 that are joined at one end to a different style of first bracket 40 and at an opposite end to a different style of second bracket 40. The cross-bars 42 form the shelf surface 32. This bottom row of shelf 30 does not have another shelf type installed over the shelf created by the cross-bars. The front edge of the bottom row of shelf 30 is supported by legs 34 and feet 36. The rear edge of the bottom row of shelf 30 is joined to the posts with brackets 38 and fasteners.

On the left side of the shelving system 10 shown in FIG. 1, the top three shelves have cross-bars 44 forming the shelf surface comparable to the cross-bar shelves 30 of the bottom row. However, for the top three left-side shelves, the cross bars 44 extend between the first and second brackets 46, 48 to create the shelf surface. The first and second brackets 46, 48 are configured for removable attachment to the support posts 12, 14.

Figure 4:
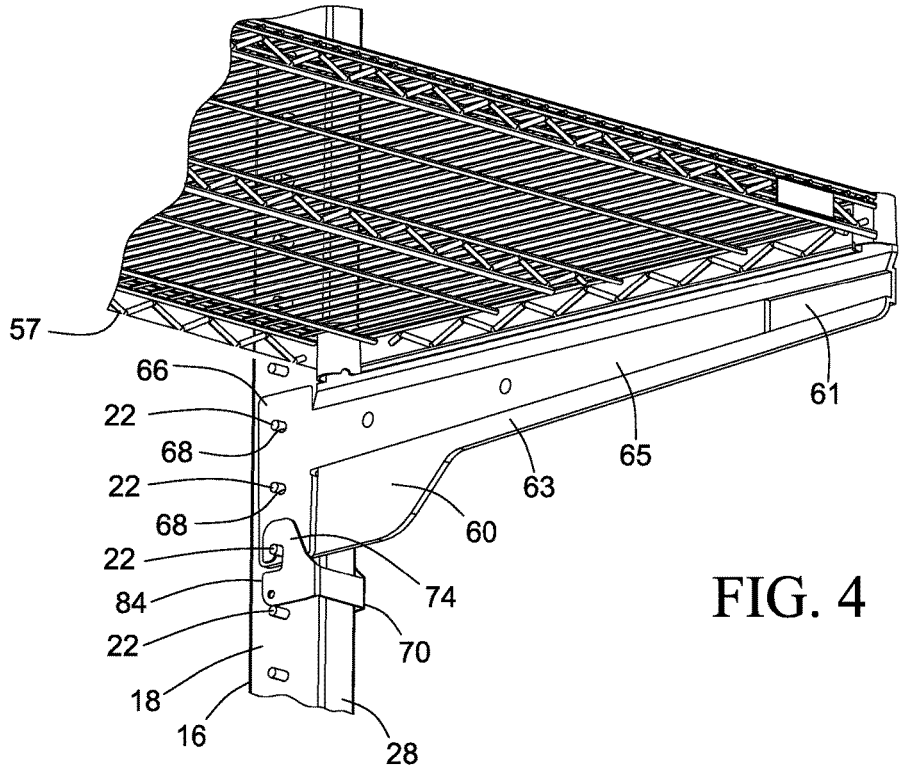
FIG. 4 is an enlarged partial left front perspective view of one shelf and one shelving bracket with locking clip attached to a mounting post of FIG. 1.

In the embodiment of the shelving system 10 shown in FIGS. 1-7, a flange portion 66 of each bracket 46, 48, 60, 62 defines two or more through holes 68 adapted to receive the pins 22 that project from the mounting surface 18 or 20 of one of the vertical posts 12, 14, 16. In the embodiment shown in FIGS. 4 and 5, each bracket flange 66 has three through holes 68. One individual pin of the series of pins 22 fits within an individual hole of the through holes 68 to mount the shelf bracket 60 to the support post 16 as illustrated in FIG. 4.

Each shelf bracket 60, 62 of the shelving system of FIGS. 1-7 is formed having two components: a bracket arm 63 or sidewall and the bracket flange 66. The bracket arm 33 defines a groove channel 61 adapted to receive a tapered tongue 65 extending away from the bracket flange 66. Each bracket arm 33 has two upstanding prongs 64 configured for insertion into one of the corners 58 of the shelf 50 to connect the shelf 50 to the shelf bracket 60, 62.

Figure 14:
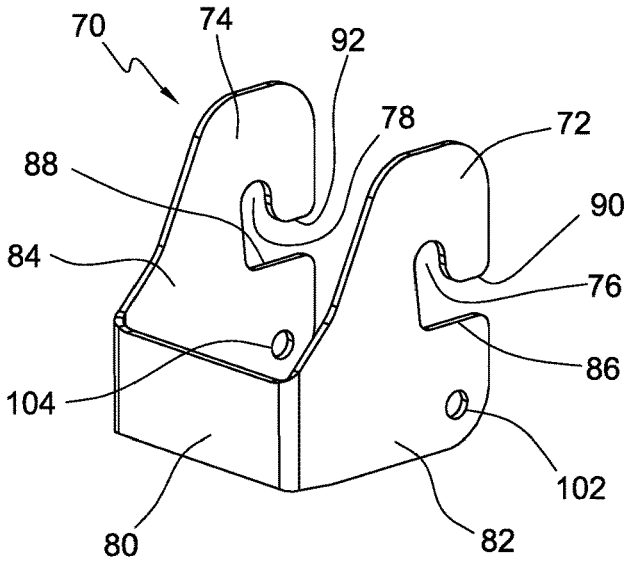
FIG. 14 is a right front perspective of a first embodiment of a locking clip.
Figure 15:
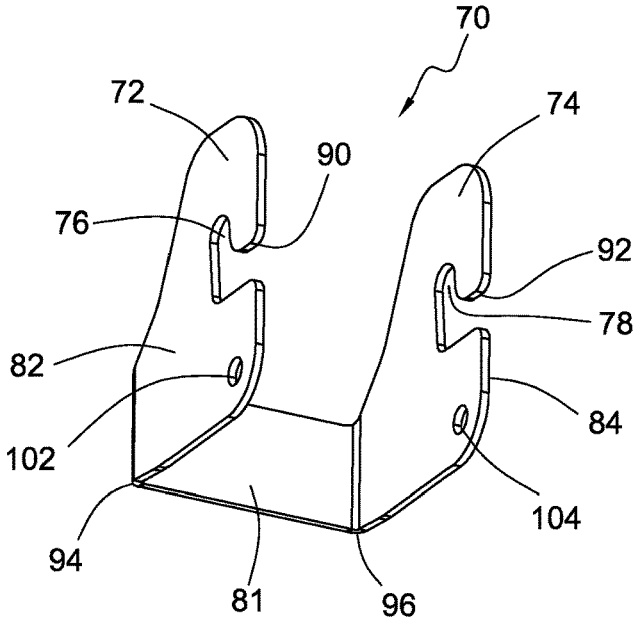
FIG. 15 is a right rear perspective view of the first embodiment of the locking clip of FIG. 14.

A bracket locking clip 70 has a C-shape with a first arm 82 spaced apart from a second arm 84 and joined together by a center portion 80. See FIGS. 14 and 15. The first arm 82 has a first hook shaped finger 72 extending outwardly from a top edge 86 of the first arm 82, and the second arm 84 has a second hook shaped finger 74 extending outwardly from a top edge 88 of the second arm 84. Preferably, the hook shaped fingers 72, 74 extend in a direction substantially perpendicular to the axis along the length of the arms 82, 84 and center portion 80. The tip 90 of the first hook shaped finger 72 is spaced apart from the top edge of the first arm 82 to define a gap or slot space 76. The tip 92 of the second hook shaped finger 74 is spaced apart from the top edge 88 of the second arm 84 to define a gap or slot space 78. Through the gap or slot space 76, the first hook shaped finger 72 is adapted to receive one of the outwardly projecting pins 22 of the second mounting surface 20 of the support post 16. Through the gap or slot space 78, the second hook shaped finger 74 is adapted to receive one of the outwardly projecting pins 22 of the first mounting surface 18 of the support post 16 that also is engaged by the flange portion 66 bracket 60.

The first and second arms 82, 84 of the bracket locking clip 70 extend at angles from the center portion 80 at bends 94, 96. Preferably, the bend angle for each of the bends 94, 96 of the clip arms of the bracket locking clip is 90 degrees or less. Each of the first and second arms 82, 84 may define holes 102, 104 therethrough.

The center portion 80 of the locking clip 70 contacts the front face 28 of the support post 16. Preferably, the arms 82, 84 of the locking clip 70 each have a width that is less than the space distance between two adjacent outwardly projecting pins 22 extending from a support post 12, 14, 16. Preferably, the hook portions 72, 74 of the locking clip 70 each have a width that is less than the space distance between two adjacent outwardly projecting pins 22 extending from a support post 12, 14, 16. Preferably, the hook portions define inner curved hook portions configured to seat around a respective projecting pin 22 extending from a support post 12, 14, 16.

Preferably, the bracket locking clip 70 is formed of a metal, such as steel or steel alloy, and has a thickness of 1 to 5 mm.

Figure 5:
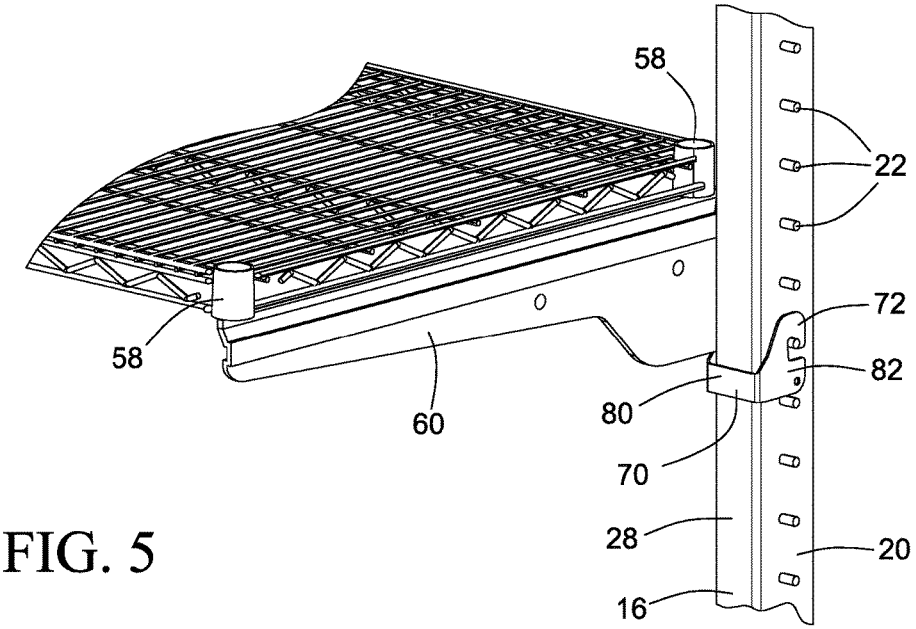
FIG. 5 is an enlarged partial right front perspective view of the one shelf and one shelving bracket with locking clip attached to a mounting post of FIG. 1.
Figure 6:
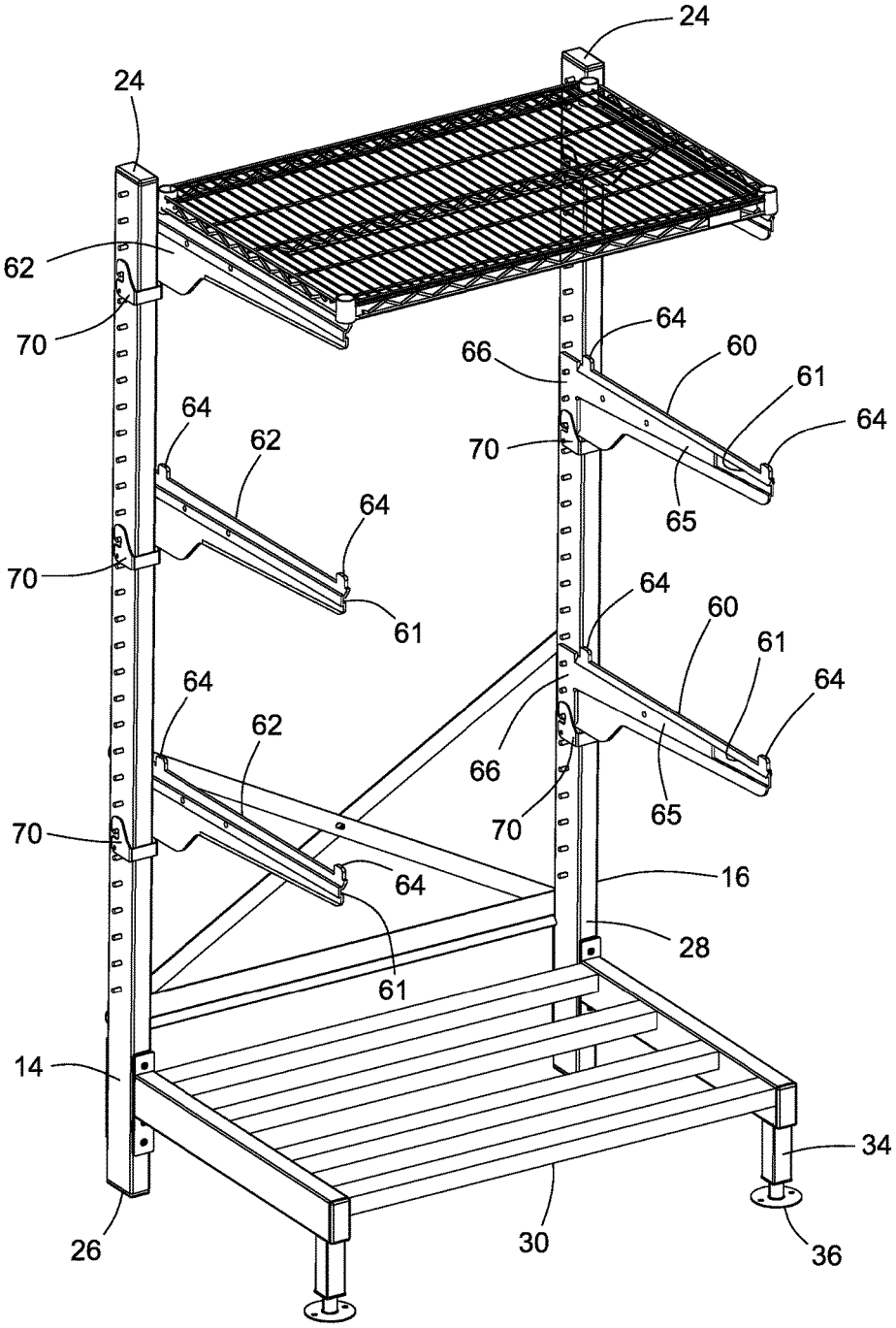
FIG. 6 is a left front perspective view of the first embodiment having three mounting posts and multiple shelving brackets to support shelves, with a wire shelf structure attached to the top row of brackets.
Figure 7:
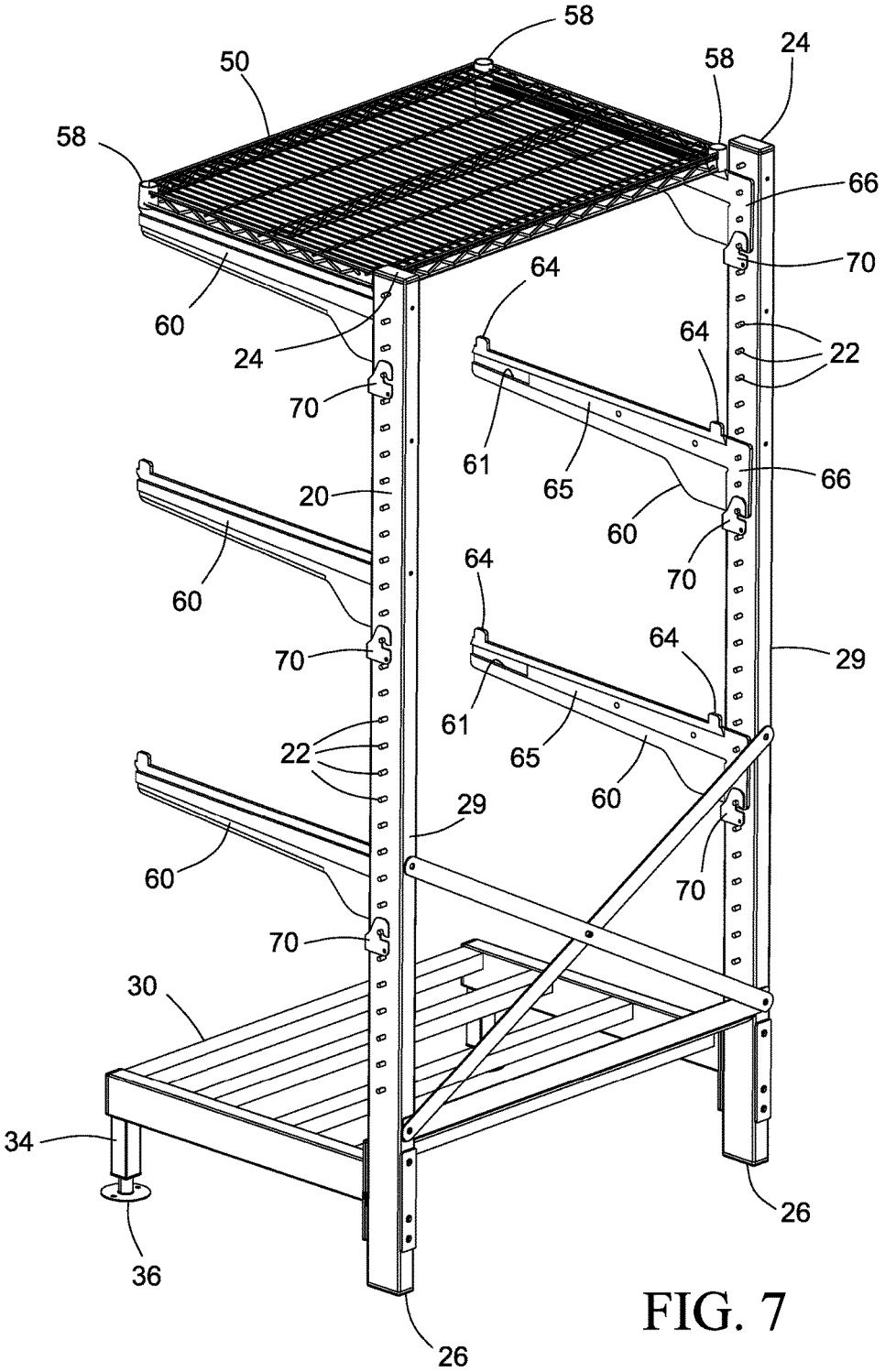
FIG. 7 is a right rear perspective view of the shelving unit shown in FIG. 6.

In the first embodiment shown, e.g., FIGS. 1-7, two locking clips 70 are used to secure one shelf assembly 50 to two support posts, e.g., support post 14 and support post 16. Referring particularly to FIGS. 4 and 5, one of the locking clips 70 is secured to one of the brackets 60 and one of the posts 16. Referring to FIG. 6, the other locking clip 70 on the left side of the shelf 50 is secured to the other of the brackets 62 and the other of the support posts 14.

To install a shelf 50 onto two posts 14, 16, the holes 68 in bracket flange portion 66 of a shelf bracket 60 are mated with corresponding pins 22 of a respective first post 16, and the holes 68 in the bracket flange portion 66 of a second shelf bracket 62 are mated with corresponding pins 22 of a respective second post 14 at a desired height above a floor or support surface. Then, a first bracket locking clip 70 is installed over the post and a portion of the bracket flange portion 66 of the first shelf bracket 60. The first arm 82 contacts the first mounting surface 18 of the post 16, and fits between two of the pins 22, with the first hook shaped finger 72 engaging one of the pins 22. See FIG. 5. The second arm 84 contacts the second mounting surface 20 of the post 16, and fits between two of the pins 22 extending from the second mounting surface, and the first hook shaped finger contacts the bracket flange portion 66 of the first bracket 60 and engages one of the pins 22. See FIG. 4. The center portion 80 of the bracket locking clip 70 contacts the front wall 28 of the post 16. See FIGS. 4 and 5.

During installation, first and second arms 82, 84 are pulled away or separated from one another a distance to enable the user to seat the bracket locking clip 70 around the post 16 and join the inner curved portion of the hook shaped fingers 72, 74 to the respective pins 22. When so installed, the shelves may be cleaned. Alternatively, the user may disassemble the shelves 50 from the posts 14, 16, by detaching the bracket locking clips 70 from the posts 14, 16, then pulling the bracket flanges 66 off of the pins 22 and away from the posts 14, 16.

Figure 8:
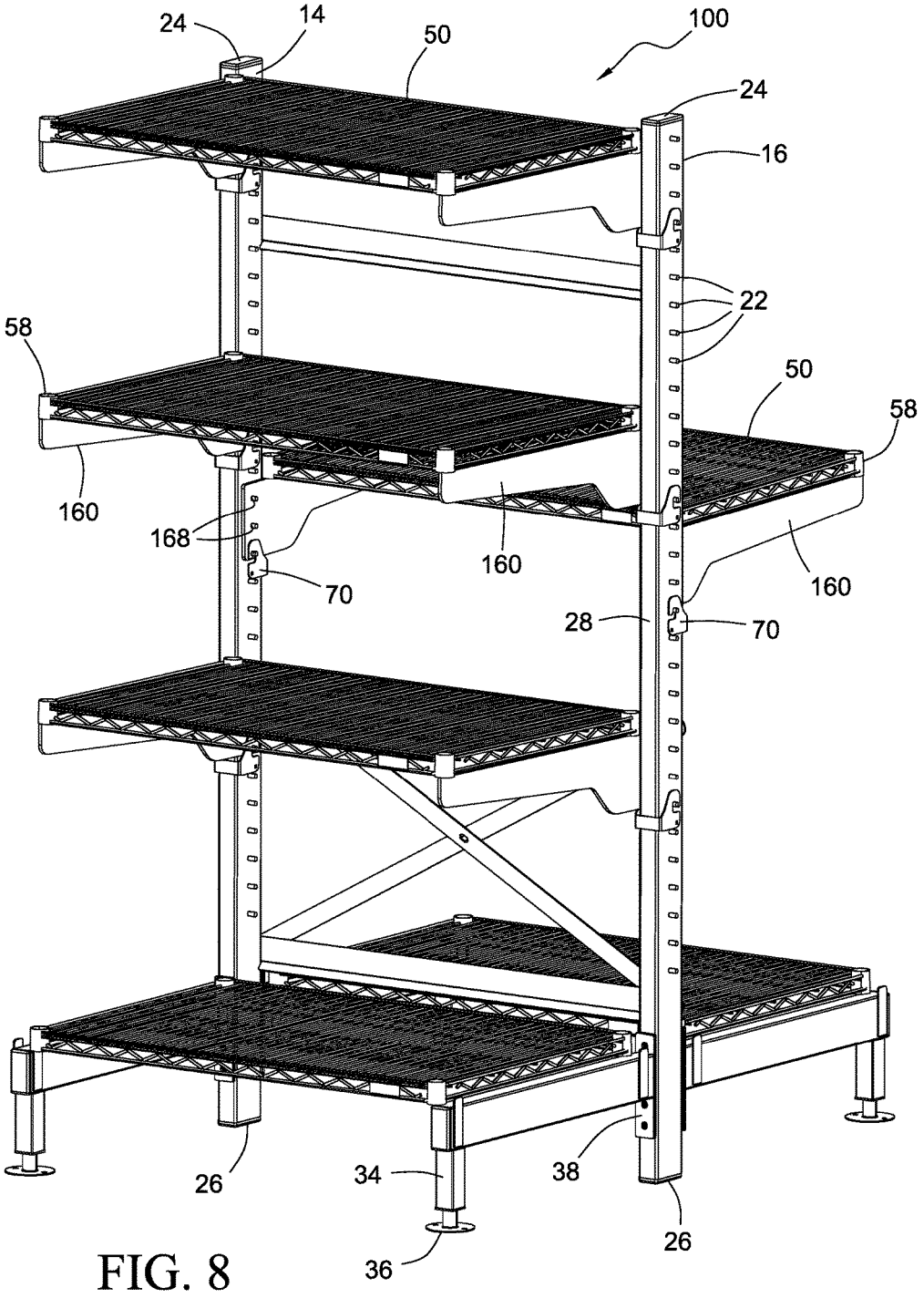
FIG. 8 is a right front perspective view of a shelving unit of a second embodiment having two mounting posts and multiple shelves with shelving brackets according to the invention attached thereto at the front of the posts and at the rear of the posts.
Figure 9:
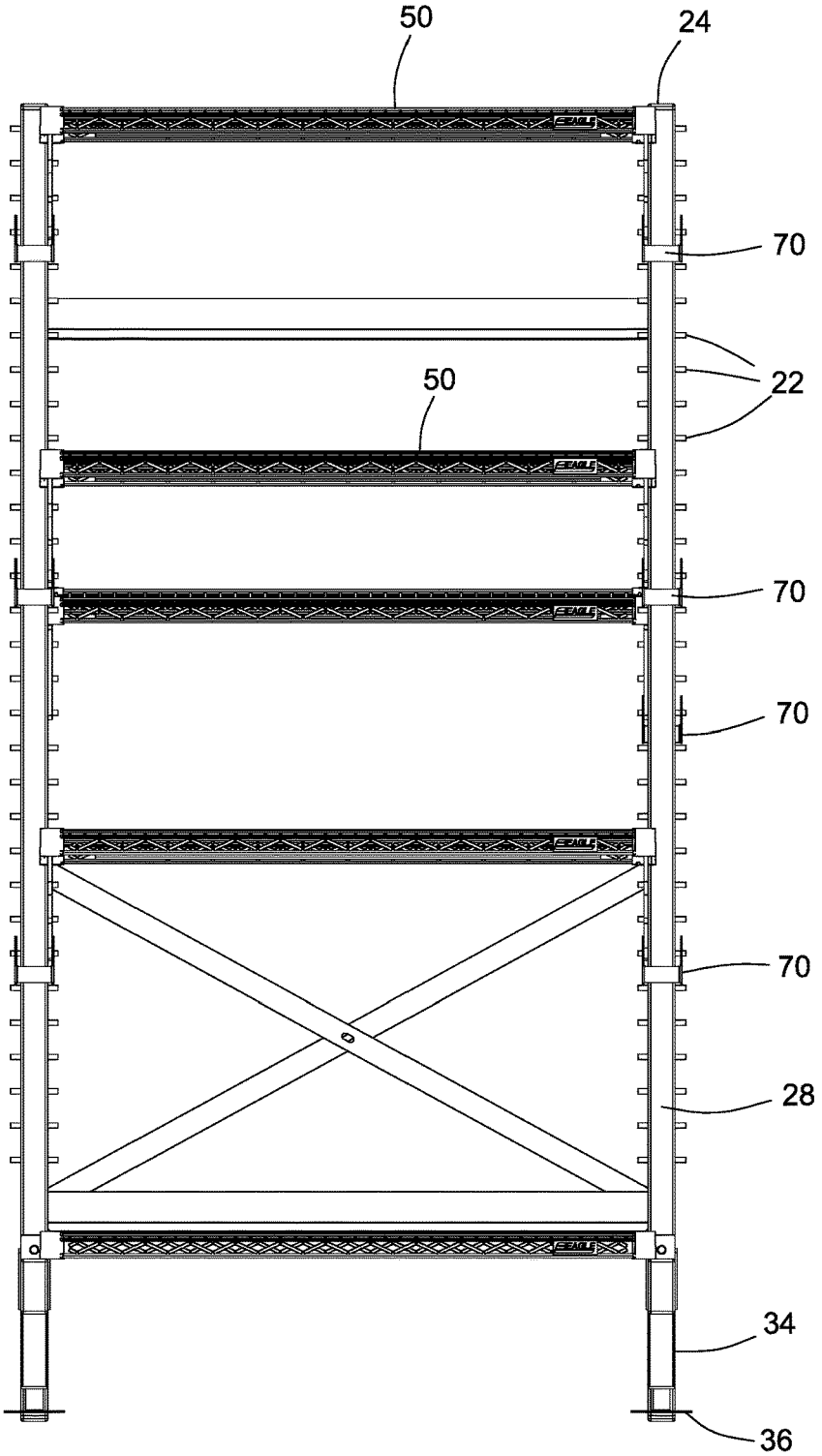
FIG. 9 is a front elevational view of the shelving unit of FIG. 8.
Figure 10:
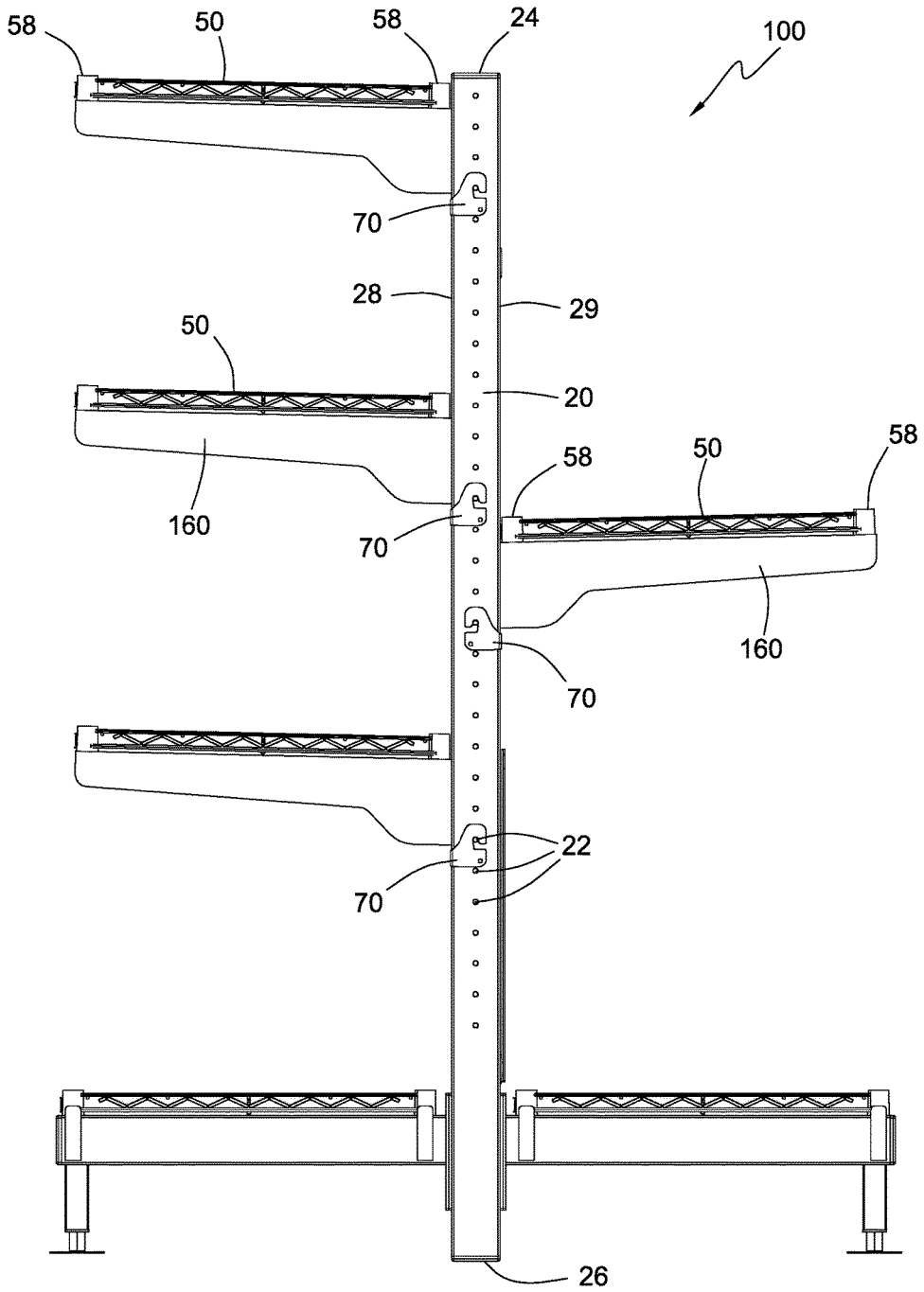
FIG. 10 is a right side elevational view of the shelving unit of FIG. 8.

As seen in more detail in FIGS. 8-10, a second embodiment of the shelving system 100 includes shelves that have brackets 160 of one-piece construction. Hence, the brackets 160 define two or more holes 168 to receive pins 22 at their proximal ends, and have prongs 161 extending upwardly from the top surfaces to receive corners 58 of respective shelves 50. The alternate embodiment of shelves with one-piece construction brackets 160 may be mounted to support posts 12, 14, 16 with bracket mounting clips 70 in the same manner as described herein for the first embodiment.

Figure 11:
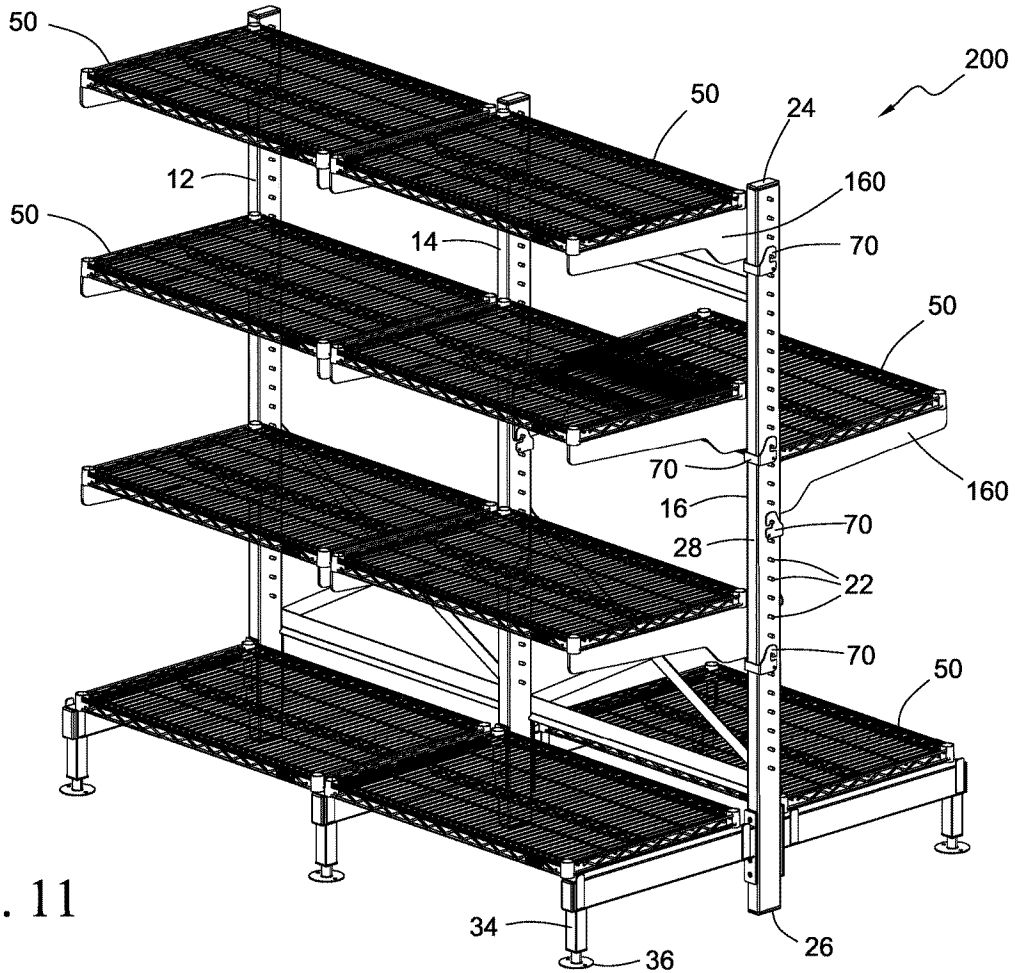
FIG. 11 is a right front perspective view of a shelving unit of a third embodiment having three mounting posts and multiple shelves with shelving brackets according to the invention attached thereto at the front of the posts, and additional shelves with shelving brackets according to the invention attached thereto at the rear of the posts.

FIG. 11 shows a third embodiment of the shelving system 200 in which three support posts 12, 14, 16 support shelves 50 in both forward extending and rearward extending directions. The shelves 50 have brackets 160 that are mounted to the support posts 12, 14, 16 with bracket mounting clips 70 in the same manner as described herein for the first embodiment.

Figure 12:
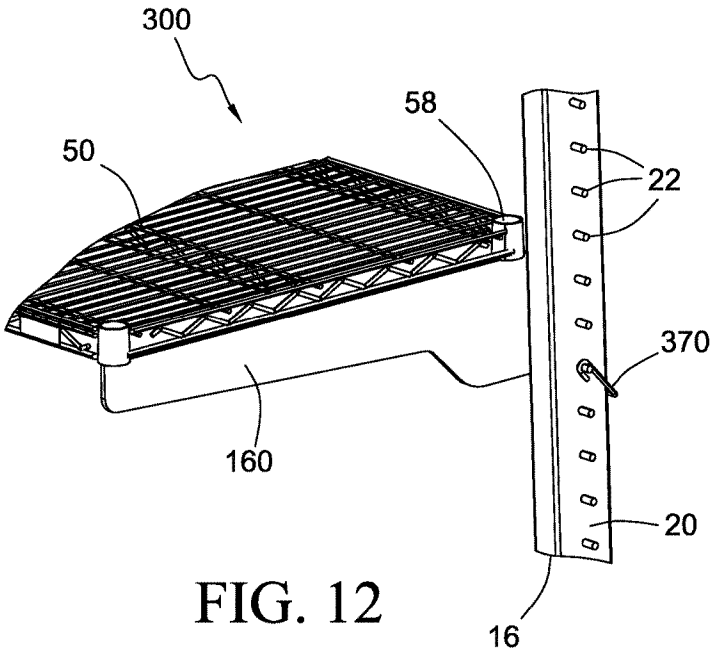
FIG. 12 is an enlarged partial left front perspective view of one shelf and one shelving bracket of a shelving system according to the invention with an alternative second locking clip attached to a mounting post.
Figure 16:
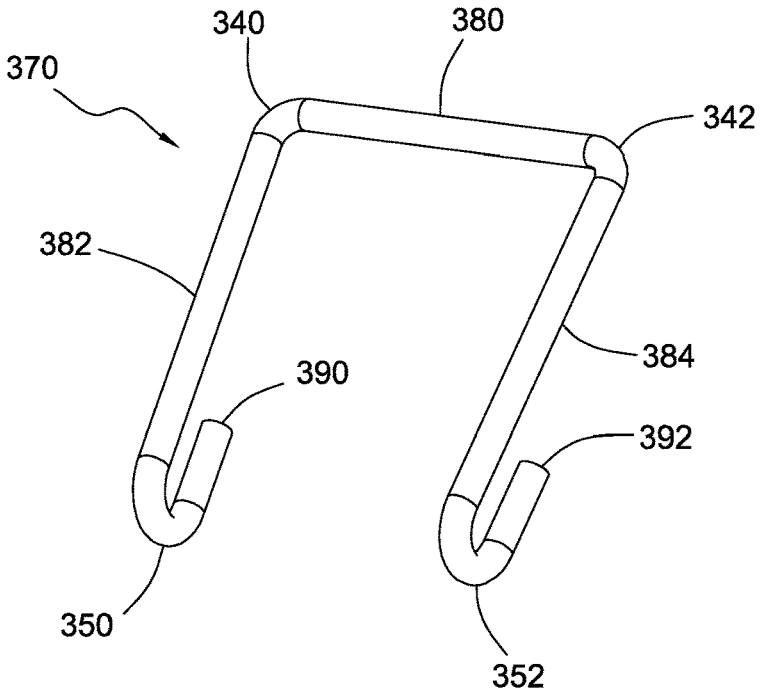
FIG. 16 is a right front perspective view of a second embodiment of a locking clip.
Figure 17:
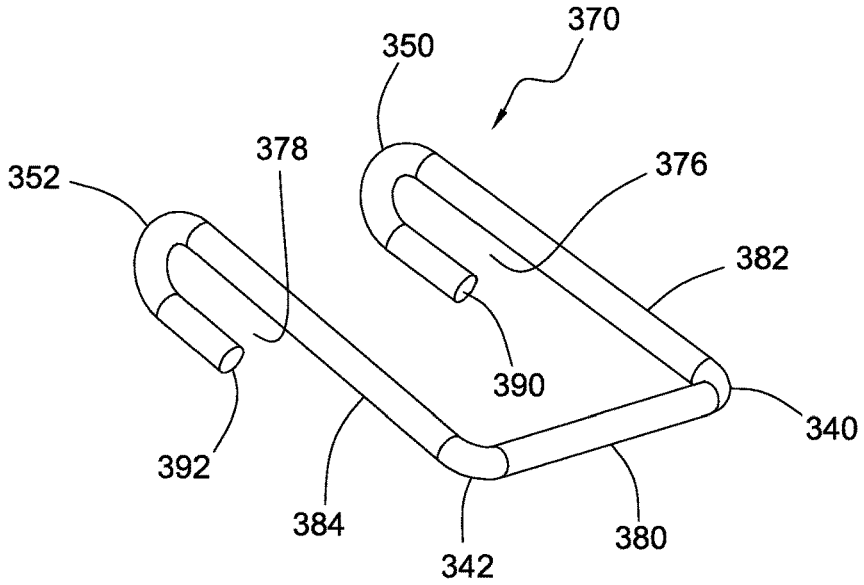
FIG. 17 is a right rear perspective view of the second embodiment of the locking clip of FIG. 16.

In an alternative arrangement, a different bracket locking clip 370 (see FIGS. 16 and 17) may be used to secure the flange 66, 166 of a bracket 60, 160 of a shelf assembly 50 to a support post 14, 16 for a shelving system 300. See FIGS. 12 and 13. The second bracket locking clip 370 is formed by bending a wire, such as a 10-gauge stainless steel wire, at two 90-degree bends 340, 342, with a straight or relatively straight middle portion 380 therebetween. The middle portion 380 has a width comparable to the combined width of a support post 14, 16 and one or two flanges of brackets. The ends of the wire are bent to form hook shaped finger portions 350, 352 with gaps or spaces 376, 378 between the side arms of the clip 382, 384 and the ends or tips 390, 392 of the wire forming the clip 370. The middle portion 380 and the side arms 382, 384 together for a C-shape. The hook shaped finger portions preferably are bent such that the ends or tips 390, 392 are spaced apart from and below the side arms 382, 384. The hook shaped finger portions 350, 352 each are adapted to receive a pin 22 extending from opposite side faces of a support post 14, 16 to secure a shelf bracket 60, 160 to the support post 14, 16.

Figure 13:
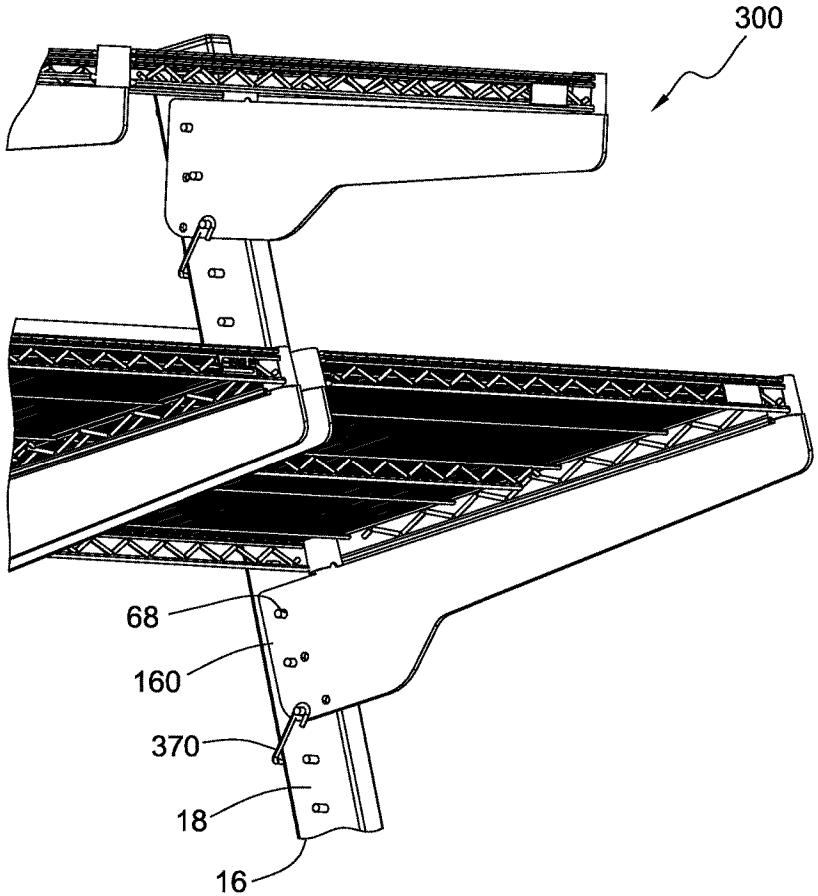
FIG. 13 is an enlarged partial right front perspective view of the one shelf and one shelving bracket with locking clip attached to a mounting post of FIG. 12.

In FIG. 13, it can be seen that holes 168 in the flange of bracket 160 can be aligned equidistant from a side edge of the bracket 160 when the shelf assembly 50 is to be installed with its supporting surface 52 in horizontal relation above a support surface. In addition, additional holes 168 in the flange of bracket 160 may be aligned at differing distances from a side edge of the bracket 160 so that the shelf assembly 50 may be installed with its supporting surface 52 disposed at an angle from horizontal above a support surface. In FIG. 13, the top shelf assembly is shown installed at an angle tilted downwardly from horizontal, with its front edge lower than its rear edge, and the second and third shelf assemblies are shown installed in horizontal position, without downwardly tilting the front edges of the shelf assemblies.

It is further contemplated that a combination of both kinds of bracket locking clips, i.e., the bracket locking clip 70 and bracket locking clip 370, could be used together to mount different shelves to posts in a shelving system.

Whether using the first embodiment 10, second embodiment 100, third embodiment 200 or fourth embodiment 300 of the shelving system, the shelves 50 may be mounted at different heights along the length of the support posts 12, 14, 16, and at orientations extending away from the front wall 28 or orientations extending away from the rear wall 29 of the same set of two posts. Compare FIGS. 8-10 with FIG. 11. The shelving systems 10, 100, 200, 300 thus offer more storage flexibility than other prior shelving systems. Moreover, the shelving systems 10, 100, 200, 300 permit a user to remove shelves for cleaning the shelves and the support posts. After such cleaning, the shelves may be installed onto the support posts 12, 14, 16 at the same or different heights as desired by the user.

Although specific forms of the invention have been selected in the preceding disclosure for illustration in specific terms for the purpose of describing these forms of the invention fully and amply for one of average skill in the pertinent art, it should be understood that various substitutions and modifications which bring about substantially equivalent or superior results and/or performance are deemed to be within the scope and spirit of the following claims. The entire disclosures of U.S. patents and patent applications identified in this application are hereby incorporated by reference herein.

The invention claimed is:

1. A shelving system, comprising:

a first support post having a first front surface, a first rear surface, a first mounting surface, a second mounting surface, a central axis, wherein the first front surface extends between the first mounting surface and the second mounting surface, a first plurality of outwardly projecting pins extending from the first mounting surface away from the central axis, and a second plurality of outwardly projecting pins extending from the second mounting surface away from the central axis;

a second support post having a second front surface, a third mounting surface, a fourth mounting surface, a second central axis, wherein the second front surface extends between the third mounting surface and the fourth mounting surface, a third plurality of outwardly projecting pins extending from the third mounting surface of the second support post away from the second central axis, and a fourth plurality of outwardly projecting pins extending from the fourth mounting surface of the second support post away from the second central axis;

a first shelf assembly including a first bracket having two or more first through holes therein, wherein one of the first through holes from said two or more first through holes receives a first pin from the first plurality of outwardly projecting pins on the first mounting surface, and a second bracket having two or more second through holes therein, wherein one of the second through holes receives a second pin from the third plurality of outwardly projecting pins on the third mounting surface of the second post;

a shelf surface for storing items thereon that is joined at one end thereof to the first bracket and at an opposite end thereof to the second bracket; and a first locking clip having a C-shaped wire defining a first arm, a second arm, and a middle section therebetween, wherein a first hook shaped finger extends outwardly from a distal end of the first arm, wherein the first hook shaped finger is generally J-shaped, and a second hook shaped finger extends outwardly from a distal end of the second arm, wherein the second hook shaped finger is generally J-shaped, wherein the first locking clip surrounds the first front surface or the first rear surface of first post with the first hook finger receiving the first pin from said first plurality of outwardly projecting pins on the first mounting surface of the first support post that is also engaged by said one of the first through holes from said two or more first through holes of the first bracket and with the second hook finger receiving a third pin from said second plurality of outwardly projecting pins of the second mounting surface on the first support post.

2. The shelving system of claim 1, further comprising a second locking clip having a second C-shaped wire defining a third arm having a third hook shaped finger extending outwardly from a distal end of the third arm and a fourth arm having a fourth hook shaped finger extending outwardly from a distal end of the fourth arm, with the third hook finger adapted to receive the second pin from the third plurality of outwardly projecting pins on the third mounting surface of the second support post that is also engaged by said one of the second through holes from said two or more second through holes of the second bracket and with the fourth hook shaped finger adapted to receive a fourth pin from said fourth plurality of outwardly projecting pins on the fourth mounting surface of the second support post.

3. The shelving system of claim 1, wherein the first arm of the first locking clip has a first diameter that is less than a space between the first pin from said first plurality of outwardly projecting pins and a fourth pin from said first plurality of outwardly projecting pins which is adjacent to the first pin from said first plurality of outwardly projecting pins on the first mounting surface of the first support post.

4. The shelving system of claim 3, wherein the second arm of the first locking clip has a second diameter that is less than a space between the third pin from said second plurality of outwardly projecting pins and a fifth pin from said second plurality of outwardly projecting pins which is adjacent to the third pin from said second plurality of outwardly projecting pins on the second mounting surface of the first support post.

5. The shelving system of claim 1, wherein the first arm of the first locking clip contacts the first mounting surface of the first support post at a location below the first pin from said first plurality of outwardly projecting pins of the first mounting surface engaged by the first hook shaped finger, the middle section of the first locking clip contacts the first front surface of the first support post, and the second arm of the first locking clip contacts the second mounting surface of the first support post.

6. The shelving system of claim 1, further comprising a second shelf assembly including a third bracket and a fourth bracket, wherein the first bracket of the first shelf assembly extends away from the first mounting surface of the first support post and the second bracket of the first shelf assembly extends away from the third mounting surface of the second support post, and wherein the third bracket of the second shelf assembly extends away from the second mounting surface opposite the first mounting surface of the first support post and the fourth bracket of the second shelf assembly extends away from the fourth mounting surface opposite the third mounting surface of the second support post.

7. The shelving system of claim 1, wherein the shelving system is supported on a ground surface, the shelving system further comprising a second shelf assembly including a third bracket, wherein the first bracket of the first shelf assembly extends away from the first mounting surface of the first support post at a first height above the ground surface, and the third bracket of the second shelf assembly extends away from the first mounting surface of the first support post at a second height above the ground surface, wherein the second height is above or below the first height above.

8. The shelving system of claim 1, further comprising:

a third support post, wherein the third support post has a third front surface, a fifth mounting surface, a sixth mounting surface, a fifth plurality of outwardly projecting pins extending from the fifth mounting surface, and a sixth plurality of outwardly projecting pins extending from the sixth mounting surface; and a second shelf assembly, said second shelf assembly including a third bracket having two or more third through holes therein, wherein one of the third through holes from said two or more third through holes receives a fourth pin from the fifth plurality of outwardly projecting pins on the fifth mounting surface of the third support post, and a fourth bracket having two or more fourth through holes therein, wherein one of the fourth through holes from said two or more fourth through holes receives the third pin from the second plurality of outwardly projecting pins on the second mounting surface of the first support post, wherein the second arm of the first locking clip engages the fourth bracket of the second shelf assembly to secure the fourth bracket to the first support post.

9. The shelving system of claim 8, further comprising:

a second locking clip having a C-shaped wire defining with a third arm having a third hook shaped finger extending outwardly from a distal end of the third arm and a fourth arm having a fourth hook shaped finger extending outwardly from a distal end of the fourth arm, with the third hook shaped finger adapted to receive the fourth pin from the fifth plurality of outwardly projecting pins on the fifth mounting surface of the third support post also engaged by the third bracket and with the fourth hook shaped finger adapted to receive a fifth pin from said sixth plurality outwardly projecting pins on the sixth mounting surface of the third support post.

10. A shelving system, comprising:

a first support post having a first front surface, a first rear surface, a first mounting surface, a second mounting surface, a central axis, wherein the first front surface extends between the first mounting surface and the second mounting surface, a first plurality of outwardly projecting pins extending from the first mounting surface away from the central axis, and a second plurality of outwardly projecting pins extending from the second mounting surface away from the central axis;

a first shelf assembly including a first bracket having two or more first through holes therein, wherein one of the first through holes from said two or more first through holes receives a first pin from said first plurality of outwardly projecting pins on the first mounting surface, and a first shelf surface that is joined at one end thereof to the first bracket;

a second shelf assembly including a second bracket having two or more second through holes therein, wherein one of the second through holes from said two or more second through holes receives a second pin from said second plurality of outwardly projecting pins on the second mounting surface of the first post, and a second shelf surface that is joined at one end thereof to the second bracket;

a first locking clip having a C-shaped wire defining a first arm, a second arm, and a middle section therebetween, wherein a first hook shaped finger extends outwardly from a distal end of the first arm, wherein the first hook shaped finger is generally J-shaped, and a second hook shaped finger extends outwardly from a distal end of the second arm, wherein the second hook shaped finger is generally J-shaped, wherein the first locking clip surrounds the first front surface or the first rear surface of first post with the first hook shaped finger receiving the first pin from said first plurality of outwardly projecting pins on the first mounting surface of the first support post that is also engaged by said one of the first through holes from said two or more first through holes of the first bracket and with the second hook shaped finger receiving the second pin from said plurality of the second outwardly projecting pins on the second mounting surface of the first support post also engaged by said one of the second through holes from said two or more second through holes of the second bracket, and wherein said first hook shaped finger contacts the first bracket to join the first shelf assembly to the first post, and said second hook shaped finger contacts the second bracket to join the second shelf assembly to the first post.

11. The shelving system of claim 10, wherein the first arm of the first locking clip has a first diameter that is less than a space between the first pin from said first plurality of outwardly projecting pins and a fourth pin from said first plurality of outwardly projecting pins which is adjacent to the first pin from said first plurality of outwardly projecting pins on the first mounting surface of the first support post.

12. The shelving system of claim 10, wherein the second arm of the first locking clip has a second diameter that is less than a space between the third pin from said second plurality of outwardly projecting pins and a fifth pin from said second plurality of outwardly projecting pins which is adjacent to the third pin from said second plurality of outwardly projecting pins on the second mounting surface of the first support post.

13. The shelving system of claim 11, wherein the the first arm of the first locking clip contacts the first mounting surface of the first support post at a location below the first pin from said first plurality of outwardly projecting pins of the first mounting surface engaged by the first hook shaped finger, the middle section of the first locking clip contacts the first front surface of the first support post, and the second arm of the first locking clip contacts the second mounting surface of the first support post.

14. The shelving system of claim 1, wherein the shelf surface comprises a plurality of cross-bars or a wire shelf.

15. The shelving system of claim 10, wherein the shelf surface comprises a plurality of cross-bars or a wire shelf.

* * * * *